US005676275A

United States Patent [19]

Khattar

[11] Patent Number: 5,676,275

[45] Date of Patent: Oct. 14, 1997

[54] MILK AND CEREAL BOWL

[76] Inventor: Jack A. Khattar, 13 King's Path, Hopewell, N.J. 08525

[21] Appl. No.: 415,303

[22] Filed: Apr. 3, 1995

[51] Int. Cl.[6] ..... A47G 19/02

[52] U.S. Cl. ..... 220/575; 220/23.83; 220/501

[58] Field of Search ..... 206/222; 220/574, 220/575, 501, 23.83, 23.8

[56] References Cited

U.S. PATENT DOCUMENTS

| | | | |
|---|---|---|---|
| 876,808 | 1/1908 | Kinert | 220/575 |
| 1,379,519 | 5/1921 | Bjornsen | 220/575 |
| 1,520,402 | 12/1924 | Clemans | 220/575 X |
| 2,170,311 | 8/1939 | Smith | 220/575 |
| 2,207,417 | 7/1940 | Smith | 220/575 |
| 2,843,287 | 7/1958 | Finley | 220/575 |
| 4,714,174 | 12/1987 | Williams | 220/501 |
| 4,844,251 | 7/1989 | Gueret | 206/222 |
| 4,986,433 | 1/1991 | Davis | 220/23.8 |
| 5,209,348 | 5/1993 | Schafer, III | 220/575 X |
| 5,241,835 | 9/1993 | Ascone | 220/501 X |
| 5,328,051 | 7/1994 | Potter et al. | 220/575 |

FOREIGN PATENT DOCUMENTS

| | | | |
|---|---|---|---|
| 991890 | 10/1951 | France | 220/23.83 |
| 16668 | of 1888 | United Kingdom | 220/575 |
| 2265816 | 10/1993 | United Kingdom | 220/501 |

*Primary Examiner*—Sue A. Weaver

*Attorney, Agent, or Firm*—Palmatier, Sjoquist, Helget & Voigt, P.A.

[57] ABSTRACT

A bowl is for retaining milk and cereal in a separated condition. The inventive device includes a lower bowl for containing milk, with an upper bowl removably coupled to the lower bowl for containing cereal. A well portion of the upper bowl extends into the lower bowl and includes a plurality of apertures permitting milk to enter the well from the lower bowl. A spoonful of the cereal can be moved into the well for contact with the milk immediately prior to consumption.

12 Claims, 4 Drawing Sheets

PRIOR ART

MILK AND CEREAL BOWL

BACKGROUND OF THE INVENTION

1. Field of the Invention

The present invention relates to bowl structures and more particularly pertains to a milk and cereal bowl for retaining the milk and cereal in a separated condition.

2. Description of the Prior Art

The use of bowl structures is known in the prior art. More specifically, bowl structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art bowl structures include U.S. Pat. No. 5,209,348; U.S. Pat. No. 4,844,251; U.S. Pat. No. 4,174,035; U.S. Pat. No. D,298,898; and U.S. Pat. No. D,283,096.

While these devices fulfill their respective, particular objectives and requirements, the aforementioned patents do not disclose a milk and cereal bowl for retaining milk and cereal in a separated condition which includes a lower bowl for containing milk, with an upper bowl removably coupled to the lower bowl for containing cereal, wherein a well portion of the upper bowl extends into the lower bowl and includes a plurality of apertures permitting milk to enter the well from the lower bowl, whereby a spoonful of the cereal can then be moved into the well for contact with the milk immediately prior to consumption.

In these respects, the milk and cereal bowl according to the present invention substantially departs from the conventional concepts and designs of the prior art, and in so doing provides an apparatus primarily developed for the purpose of retaining milk and cereal in a separated condition immediately prior to consumption thereof.

SUMMARY OF THE INVENTION

In view of the foregoing disadvantages inherent in the known types of bowl structures now present in the prior art, the present invention provides a new milk and cereal bowl construction wherein the same can be utilized for retaining milk and cereal in a separated condition. As such, the general purpose of the present invention, which will be described subsequently in greater detail, is to provide a new milk and cereal bowl apparatus and method which has many of the advantages of the bowl structures mentioned heretofore and many novel features that result in a milk and cereal bowl which is not anticipated, rendered obvious, suggested, or even implied by any of the prior art bowl structures, either alone or in any combination thereof.

To attain this, the present invention generally comprises a bowl for retaining milk and cereal in a separated condition. The inventive device includes a lower bowl for containing milk, with an upper bowl removably coupled to the lower bowl for containing cereal. A well portion of the upper bowl extends into the lower bowl and includes a plurality of apertures permitting milk to enter the well from the lower bowl. A spoonful of the cereal can be moved into the well for contact with the milk immediately prior to consumption.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new milk and cereal bowl apparatus and method which has many of the advantages of the bowl structures mentioned heretofore and many novel features that result in a milk and cereal bowl which is not anticipated, rendered obvious, suggested, or even implied by any of the prior art bowl structures, either alone or in any combination thereof.

It is another object of the present invention to provide a new milk and cereal bowl which may be easily and efficiently manufactured and marketed.

It is a further object of the present invention to provide a new milk and cereal bowl which is of a durable and reliable construction.

An even further object of the present invention is to provide a new milk and cereal bowl which is susceptible of a low cost of manufacture with regard to both materials and labor, and which accordingly is then susceptible of low prices of sale to the consuming public, thereby making such milk and cereal bowls economically available to the buying public.

Still yet another object of the present invention is to provide a new milk and cereal bowl which provides in the apparatuses and methods of the prior art some of the advantages thereof, while simultaneously overcoming some of the disadvantages normally associated therewith.

Still another object of the present invention is to provide a new milk and cereal bowl for retaining milk and cereal in a separated condition, thereby allowing the cereal to remain crispy and crunchy until it is consumed.

Yet another object of the present invention is to provide a new milk and cereal bowl which includes a lower bowl for containing milk, with an upper bowl removably coupled to the lower bowl for containing cereal, wherein a well portion of the upper bowl extends into the lower bowl and includes a plurality of apertures permitting milk to enter the well from the lower bowl, whereby a spoonful of the cereal can then be moved into the well for contact with the milk immediately prior to consumption.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
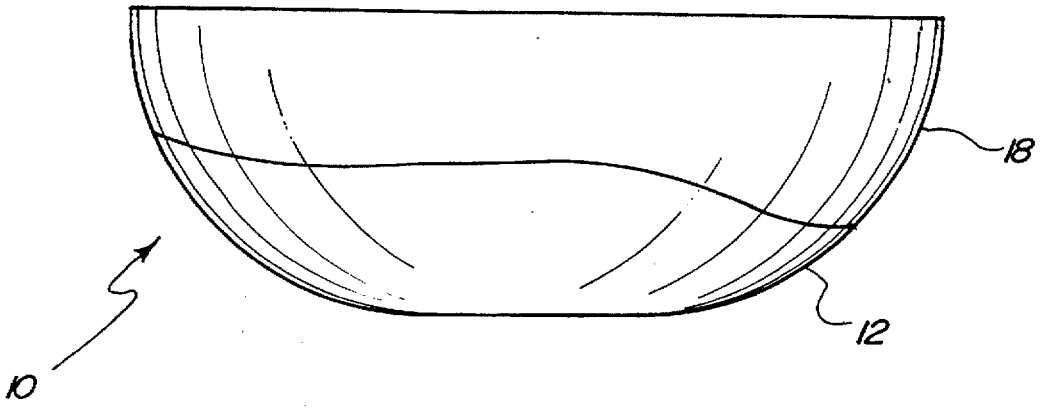
FIG. 3 is a side elevation view of a milk and cereal bowl according to the present invention.
Figure 4:
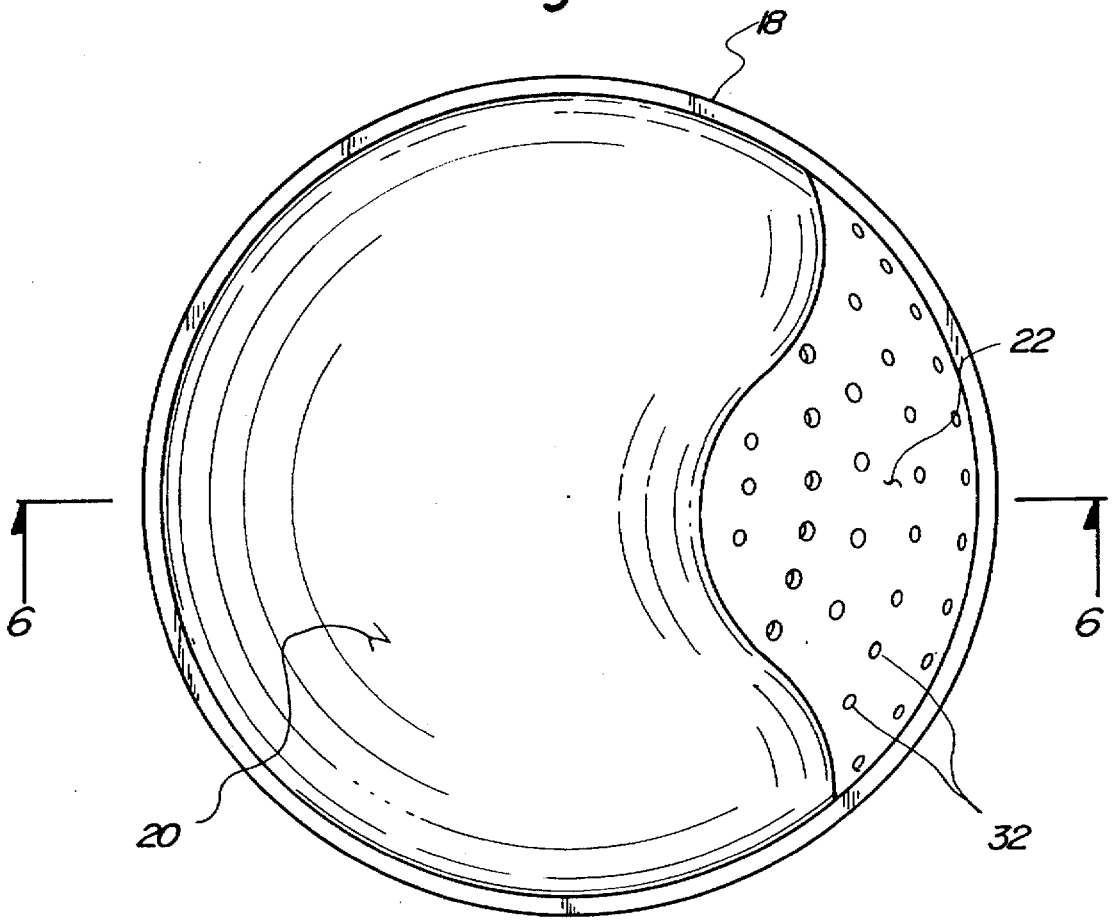
FIG. 4 is a top plan view thereof.
Figure 5:
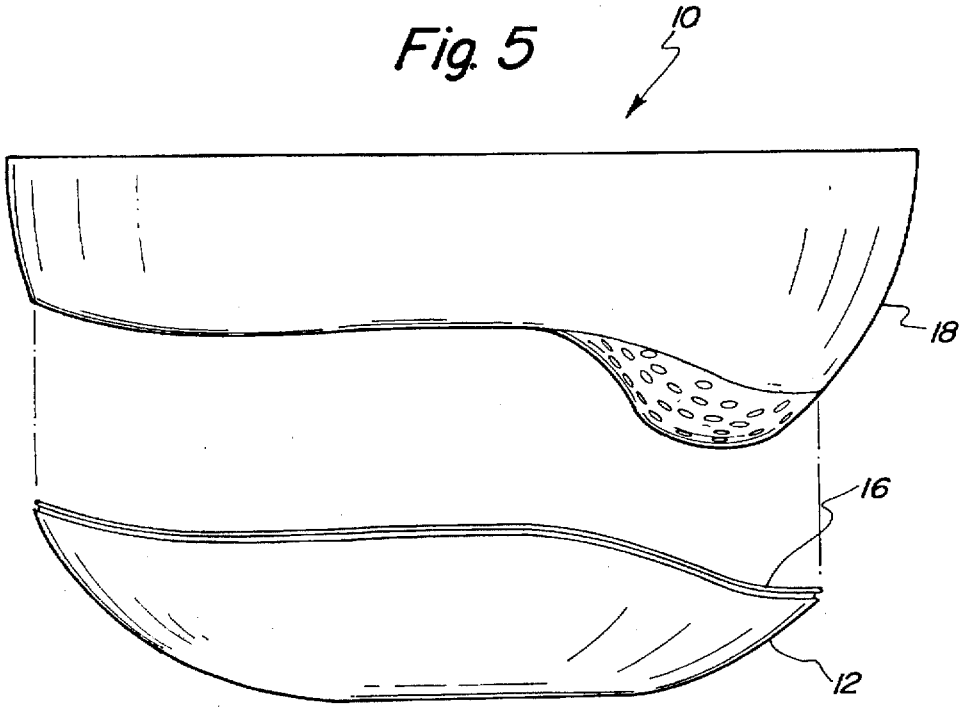
FIG. 5 is an exploded side elevation view of the present invention.

With reference now to the drawings, and in particular to FIG. 3 thereof, a new milk and cereal bowl embodying the principles and concepts of the present invention and generally designated by the reference numeral 10 will be described.

Figure 1:
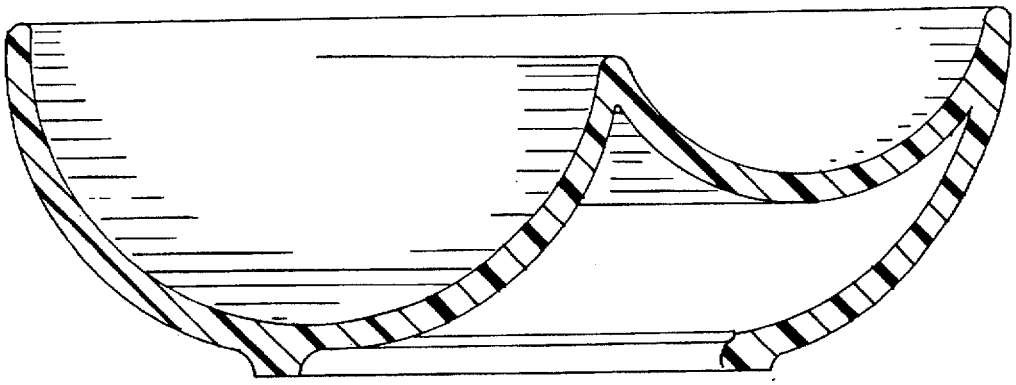
FIG. 1 is a cross-sectional view of a prior art bowl structure.
Figure 2:
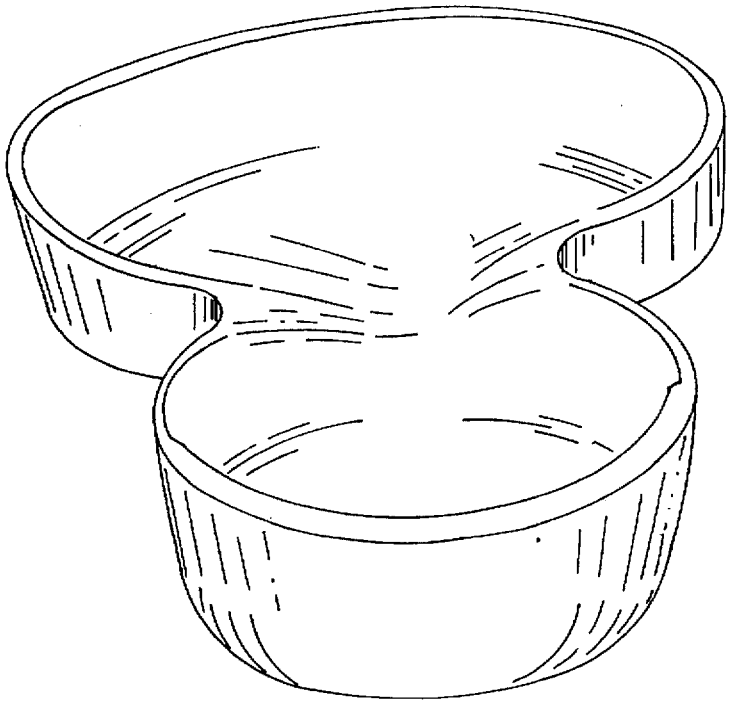
PRIOR ART Fig. 2
FIG. 2 is an isometric illustration of a further prior art bowl structure.

Turning initially to FIGS. 1 and 2 wherein prior art bowl structures are illustrated, it can be shown that the prior art teaches separating milk from cereal within a bowl by a projecting weir or other separating wall structure.

Figure 6:
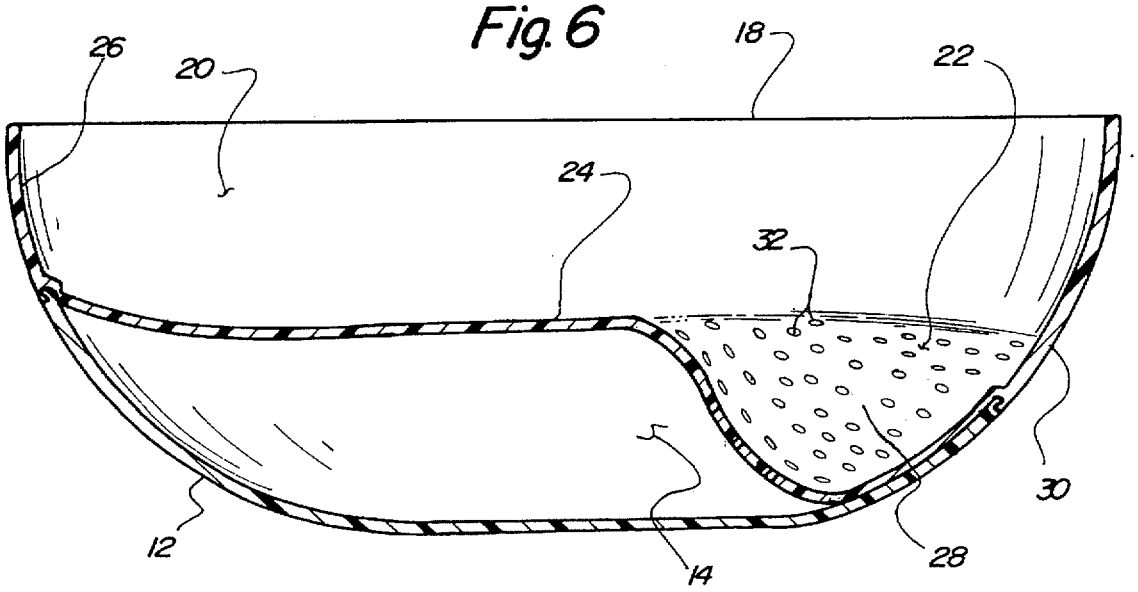
FIG. 6 is a cross-sectional view taken along line 6—6 of FIG. 4.

Referring now to FIGS. 3 through 6 wherein the present invention 10 is illustrated in detail, it can be shown that the milk and cereal bowl disclosed herein substantially departs from the designs of the prior art and comprises a lower bowl 12 having an unlabelled circumferential side wall terminating in a contoured upper edge thereof. The lower bowl 12 defines a milk reservoir 14, as shown in FIG. 6, within which milk or the like can be positioned. A flange 16 projects upwardly from the contoured upper edge of the lower bowl 12 and is operable to releasably engage an upper bowl 18 to couple the two bowls together. The upper bowl 18 defines a cereal reservoir 20 within which a comestible such as cereal or the like can be positioned. The upper bowl 18 further defines a well 22 which extends into the milk reservoir 14 of the lower bowl 12, as shown in FIG. 6. To this end, the upper bowl 18 includes a cereal reservoir bottom wall 24 having a cereal reservoir side wall 26 projecting upwardly from a perimeter of the bottom wall 24 to define the cereal reservoir 20, and a well bottom wall 28 extending at an oblique angle downward relative to the cereal reservoir bottom wall 24, with a well side wall 30 projecting upwardly from a perimeter of the well bottom wall to define the well 22. A plurality of apertures 32 extend through the well bottom wall 28 to permit fluid communication through the well bottom wall, wherein milk within the milk reservoir 14 will enter the well 22. By this structure, milk can be positioned within the milk reservoir 14, with cereal being positioned in the cereal reservoir 20, whereby a movement of the cereal from the cereal reservoir to the well 22 will result in contact of the cereal with the milk in the well to prepare the cereal for subsequent consumption by an individual.

In use, milk or other liquids can be easily positioned within the milk reservoir 14 of the lower bowl 42 with the upper bowl 18 removed or through the apertures 32 while the bowl 48 is coupled to the lower bowl 12. The upper bowl 18 can then be coupled to the lower bowl 12 through engagement of the flange 16 to a circumferential groove extending along lower edges of the cereal reservoir side wall 26 and the well side wall 30 of the upper bowl 18. The milk within the milk reservoir 14 will then flow through the apertures 32 and into the well 22, whereby cereal positioned within the cereal reservoir 20 can be moved into the well 22 to contact the milk therein as desired. Subsequent to use of the device 10, the upper bowl 18 can be separated from the lower bowl 12 for cleaning and/or storage purposes. The device 10 is preferably comprised entirely of a plastic material suitable for washing within a dishwasher.

Figure 7:
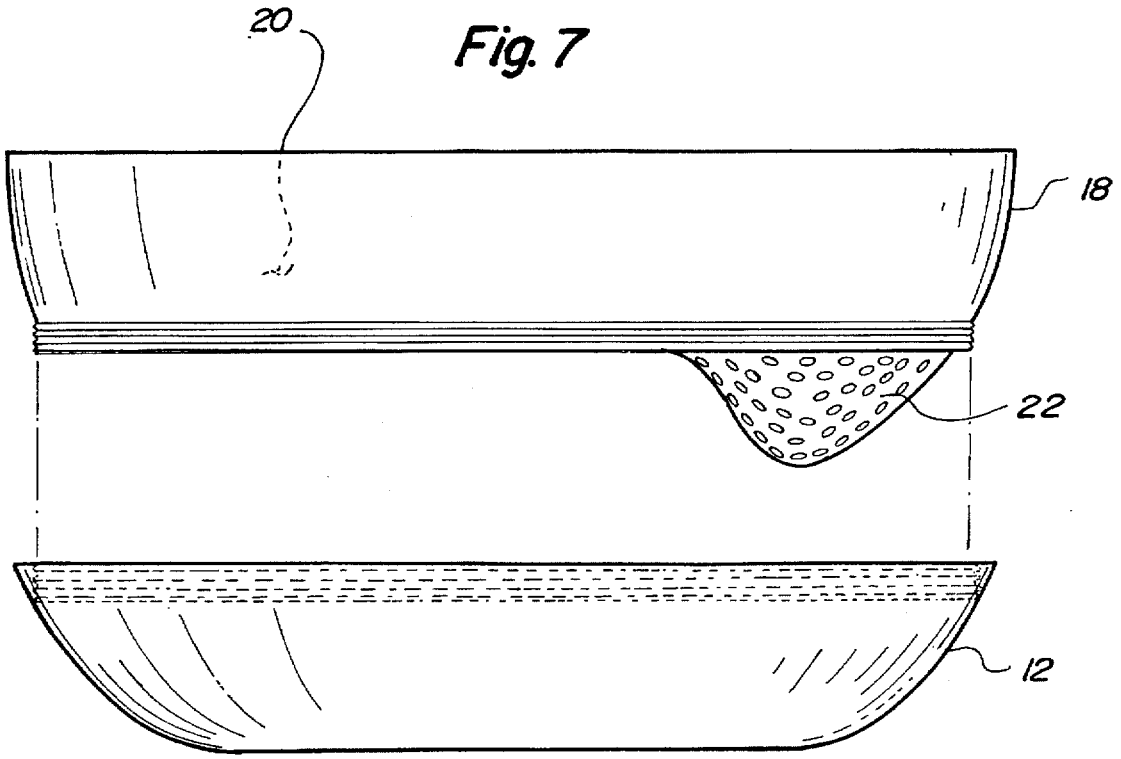
FIG. 7 is an exploded side elevation view of an alternative form of the present invention.

Referring now to FIG. 7 wherein an alternative form of the present invention 10 is illustrated, it can be shown that the lower bowl 12 may having a circumferential side wall terminating in a straight upper edge including threads formed thereon. The upper bowl 18 may also include threads cooperable with the threads of the lower bowl 12 to effect coupling the two bowls together, as shown in FIG. 7.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A milk and cereal bowl comprising:

(a) a lower bowl having a circumferential side wall terminating at an upper edge, the lower bowl being shaped so as to define a milk reservoir within which milk can be positioned; and (b) an upper bowl releasably coupled to the lower bowl, the upper bowl having a cereal reservoir within which a comestible can be positioned, the cereal reservoir separated from the milk reservoir by a cereal reservoir bottom wall defining a well, the well extending into the milk reservoir, the well having a plurality of apertures allowing fluid communications between the well and the milk reservoir wherein milk positioned in the milk reservoir may enter the well and the comestible in the cereal reservoir may be positioned for individual control of milk exposure to the comestible by moving a predetermined quantity of the comestible from the cereal reservoir to the well.

2. The milk and cereal bowl of claim 1, the cereal reservoir further comprising a cereal reservoir side wall projecting upwardly from a perimeter of the cereal reservoir bottom wall to further define the cereal reservoir, a well bottom wall extending from the cereal reservoir bottom wall at an oblique angle downward relative to the cereal reservoir bottom wall and a well side wall projecting upwardly from a perimeter of the well bottom wall to further define the well, the plurality of apertures extending through the well bottom wall.

3. The milk and cereal bowl of claim 2, further comprising a flange projecting from the upper edge of the lower bowl, the upper bowl including a circumferential groove extending along lower edges of the cereal reservoir side wall and the well side wall, the flange for releasably engaging the groove to couple the upper bowl to the lower bowl.

4. The milk and cereal bowl of claim 2, further comprising threads formed on the upper edge of the circumferential side wall of the lower bowl and threads on the upper bowl cooperable with the threads of the lower bowl to couple the bowls together.

5. A milk and cereal bowl comprising:

(a) a lower bowl having a circumferential side wall terminating in a contoured upper edge and an open top, a milk reservoir defined in the lower bowl; and (b) an upper bowl removably attached to the contoured edge of the lower bowl, the upper bowl having a bottom wall and a side wall projecting upwardly from the bottom wall, a cereal reservoir in the upper bowl for separation of a comestible from milk as positioned in the lower bowl, a well in the upper bowl extending downwardly from the cereal reservoir into the milk in the lower bowl, a plurality of apertures in the well allowing fluid communication between the well and the milk reservoir whereby the comestible placed in the cereal reservoir may be mixed with milk at a desired rate by moving a predetermined quantity of the comestible from the cereal reservoir to the well for mixing with the milk.

6. The milk and cereal bowl of claim 5 further comprising a flange projecting upwardly from the contoured upper edge of the lower bowl and a circumferential groove extending along the side wall of the upper bowl for removably connecting the upper bowl to the lower bowl.

7. The milk and cereal bowl of claim 5 further comprising threads on the contoured upper edge of the lower bowl and threads on the side wall of the upper bowl for threadably connecting the upper bowl to the lower bowl.

8. The milk and cereal bowl of claim 5 wherein the upper bowl is formed from plastic.

9. The milk and cereal bowl of claim 5 wherein the lower bowl is formed from plastic.

10. The milk and cereal bowl of claim 9 wherein the upper bowl is formed from plastic.

11. The milk and cereal bowl of claim 5, the well further comprising a well bottom wall, the well bottom wall having said plurality of apertures and positioned in the milk reservoir.

12. The milk and cereal bowl of claim 11, wherein said well bottom wall extends at an oblique angle from the bottom wall.

* * * * *

UNITED STATES PATENT AND TRADEMARK OFFICE

CERTIFICATE OF CORRECTION

PATENT NO. : 5,676,275

DATED : October 14, 1997

INVENTOR(S) : Jack A. Khattar

It is certified that error appears in the above-identified patent and that said Letters Patent is hereby corrected as shown below:

Column 4, line 9, delete "42" and insert --12--.

Column 4, line 9, delete "48" and insert --18--.

Signed and Sealed this

Seventh Day of April, 1998

Bruce Lehman

*Attest:*

BRUCE LEHMAN

*Attesting Officer*

*Commissioner of Patents and Trademarks*